US012326071B2

(12) United States Patent
Zhang et al.

(10) Patent No.: US 12,326,071 B2
(45) Date of Patent: Jun. 10, 2025

(54) INFLOW CONTROL DEVICE, METHOD AND SYSTEM

(71) Applicant: Baker Hughes Oilfield Operations LLC, Houston, TX (US)

(72) Inventors: Zhihui Zhang, Katy, TX (US); Guijun Deng, The Woodlands, TX (US); Bin Zhu, Houston, TX (US); Daniel Ewing, Katy, TX (US); Rowland Moffatt, Humble, TX (US); John Wakefield, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/447,713

(22) Filed: Aug. 10, 2023

(65) Prior Publication Data

US 2025/0052137 A1 Feb. 13, 2025

(51) Int. Cl.
*E21B 43/12* (2006.01)
*E21B 43/38* (2006.01)

(52) U.S. Cl.
CPC ..... *E21B 43/12* (2013.01); *E21B 43/38* (2013.01)

(58) Field of Classification Search
CPC ..... E21B 43/12; E21B 43/38
See application file for complete search history.

(56) References Cited

U.S. PATENT DOCUMENTS 5,961,841 A * 10/1999 Bowers ..... E21B 43/38 210/195.1
6,000,468 A * 12/1999 Pringle ..... E21B 47/10 137/101.21
10,145,223 B2 12/2018 Moen et al.
10,597,984 B2 3/2020 Moen et al.
2005/0218088 A1 10/2005 Gonzalez et al.
2006/0076150 A1* 4/2006 Coronado ..... E21B 43/32 166/250.15
2006/0186038 A1* 8/2006 Nassif ..... B04C 5/12 210/512.3

(Continued)

OTHER PUBLICATIONS

Cui, et al.; "A Novel Automatic Inflow-Regulating Valve for Water Control inHorizontal Wells"; ACS Omega 2020, 5, 28056-28072; 17 pages.

(Continued)

*Primary Examiner* — Shane Bomar
(74) *Attorney, Agent, or Firm* — Baker Hughes Patent Organization

(57) ABSTRACT

An inflow control device (ICD), including a hydrocyclonic device having a plurality of pressure taps therein and a valve responsive to differential pressure of the plurality of pressure taps. An inflow control device (ICD) including a switch having a primary flow inlet and a primary flow outlet, and a trigger that generates a differential pressure in the trigger due to separation of fluids having different densities. A method for allowing flow of a desired fluid while retarding a flow of undesired fluid in a flow control device, including flowing a pilot fluid through a fluid separator, separating components of the pilot fluid, applying differential pressure of two of the separated components to a valve that is actuated by differential pressure, flowing or retarding flow of a primary flow through the valve in response to the differential pressure.

14 Claims, 5 Drawing Sheets

(56) References Cited

U.S. PATENT DOCUMENTS

| | | | | |
|---|---|---|---|---|
| 2014/0041731 | A1 | 2/2014 | Fripp et al. | |
| 2015/0053417 | A1* | 2/2015 | Holderman | E21B 34/08 166/373 |
| 2015/0167413 | A1* | 6/2015 | Leuchtenberg | E21B 21/106 166/357 |
| 2016/0215598 | A1* | 7/2016 | Lopez | E21B 43/088 |
| 2021/0062648 | A1* | 3/2021 | Tian | E21B 47/10 |
| 2022/0403719 | A1* | 12/2022 | Zhang | E21B 43/12 |
| 2024/0019878 | A1* | 1/2024 | Mathiesen | G05D 7/0113 |
| 2024/0401444 | A1* | 12/2024 | McChesney | E21B 43/12 |

OTHER PUBLICATIONS

Schlumberger, "Autonomous ICD; Dynamically controls and delays gas and water influx"; SLB.com/aicd; 2 pages; retrieved from the internet Jul. 12, 2023; https://www.slb.com/-/media/files/sand-control/product-sheet/aicd-ps.ashx.

Zhang, et al.; "A new autonomous inflow control device designed for a loose sand oilreservoir with bottom water"; Journal of Petroleum Science Engineering, 2019; https://doi.org/10.1016/j.petrol.2019.03.034Received Oct. 29, 2018; 12 pages.

* cited by examiner

Single-phase flow

Multi-phase flow

INFLOW CONTROL DEVICE, METHOD AND SYSTEM

BACKGROUND

In the resource recovery industry especially in mature wells, there is a risk of producing a greater percentage of water in the target fluid. To address the issue, inflow control devices attempt to exclude higher water percentage fluids while allowing lower water percentage fluids to flow into the borehole. Some success has been achieved with available inflow control devices but greater specificity is desired. Alternate technologies that help to improve the selective inflow of target fluids over water are always of interest to the art.

SUMMARY

An embodiment of an inflow control device (ICD), including a hydrocyclonic device having a plurality of pressure taps therein and a valve responsive to differential pressure of the plurality of pressure taps.

An embodiment of an inflow control device (ICD) including a switch having a primary flow inlet and a primary flow outlet, and a trigger that generates a differential pressure in the trigger due to separation of fluids having different densities.

An embodiment of a method for allowing flow of a desired fluid while retarding a flow of undesired fluid in a flow control device, including flowing a pilot fluid through a fluid separator, separating components of the pilot fluid, applying differential pressure of two of the separated components to a valve that is actuated by differential pressure, flowing or retarding flow of a primary flow through the valve in response to the differential pressure.

An embodiment of a wellbore system, including a borehole in a subsurface formation, a string in the borehole, the ICD disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
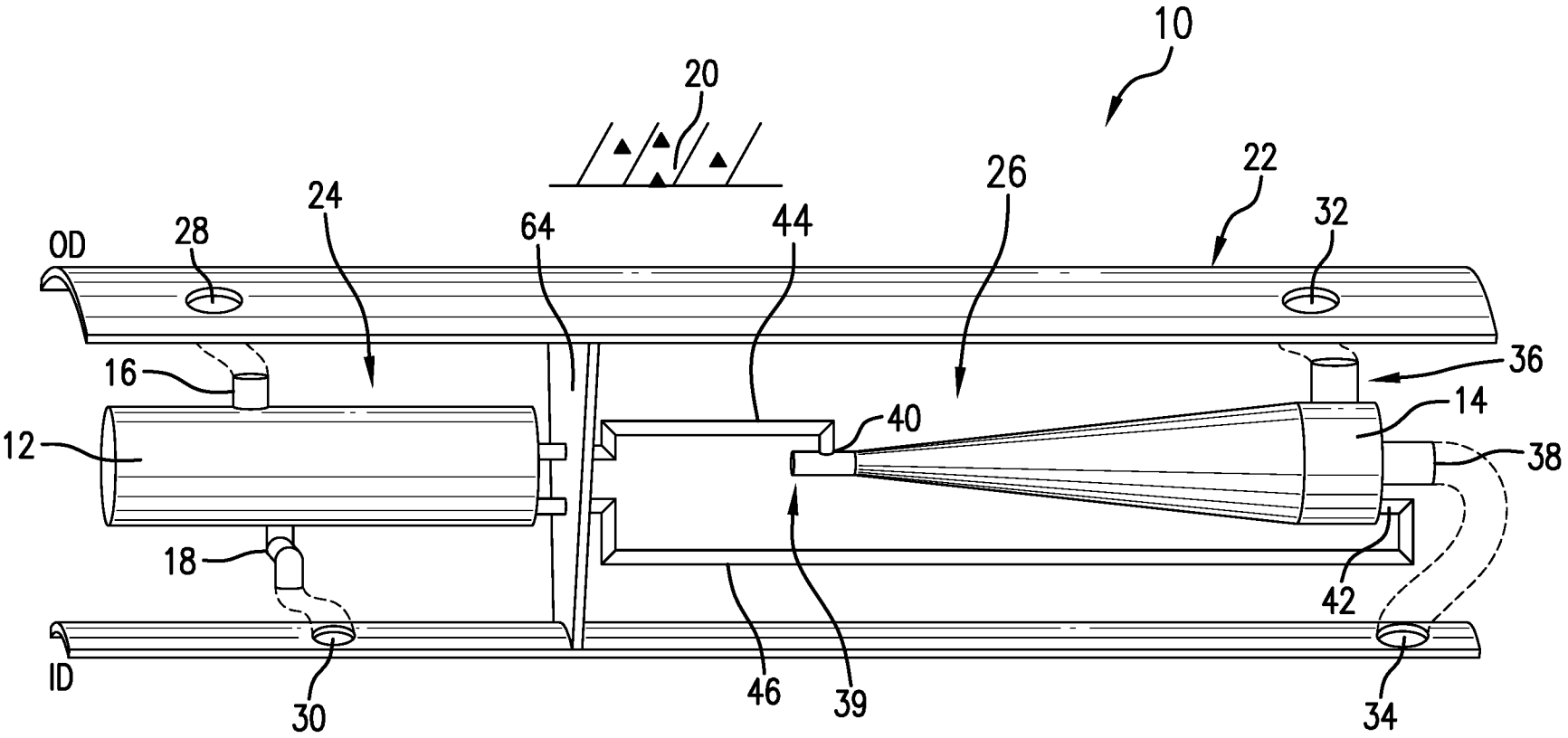
FIG. 1 is a schematic view of an inflow control device as disclosed herein.
Figure 2:
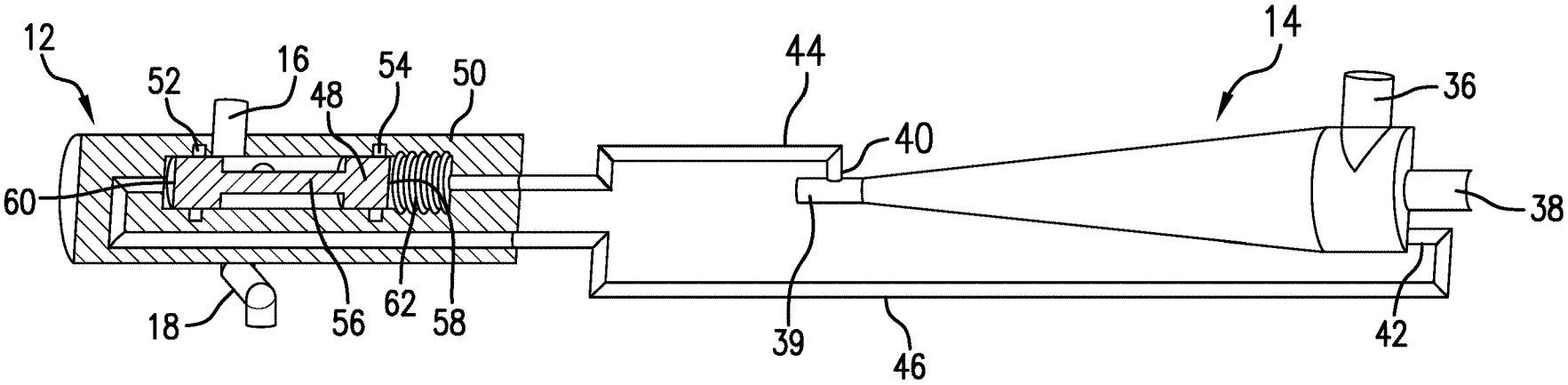
FIG. 2 is a portion of the view of FIG. 1 illustrated in partial cross section.

Referring to FIGS. 1 and 2, an inflow control device 10 is illustrated. The device 10 comprises a switch 12 that may be a valve, and a trigger 14 configured to provide an input to the switch that results in the switch being opened, closed, or choked. In some embodiments the trigger 14 is a hydrocyclone fluid separator device.

The switch 12 includes a primary flow inlet 16 and a primary flow outlet 18. Depending upon the position of the switch 12, the primary flow is allowed, or is impeded, or is prevented. The primary flow, while the device is in use in a wellbore environment, is fluid coming from a formation 20 (see also FIG. 5). As illustrated the device 10 is positioned within a tubular housing 22 that defines annular or part annular chambers 24 and 26. Ports 28, 30, 32, and 34 are illustrated in schematic form to allow fluid flow into and out of the switch 12 and trigger 14, respectively. Screens, etc. might be included in practice.

Figure 3:
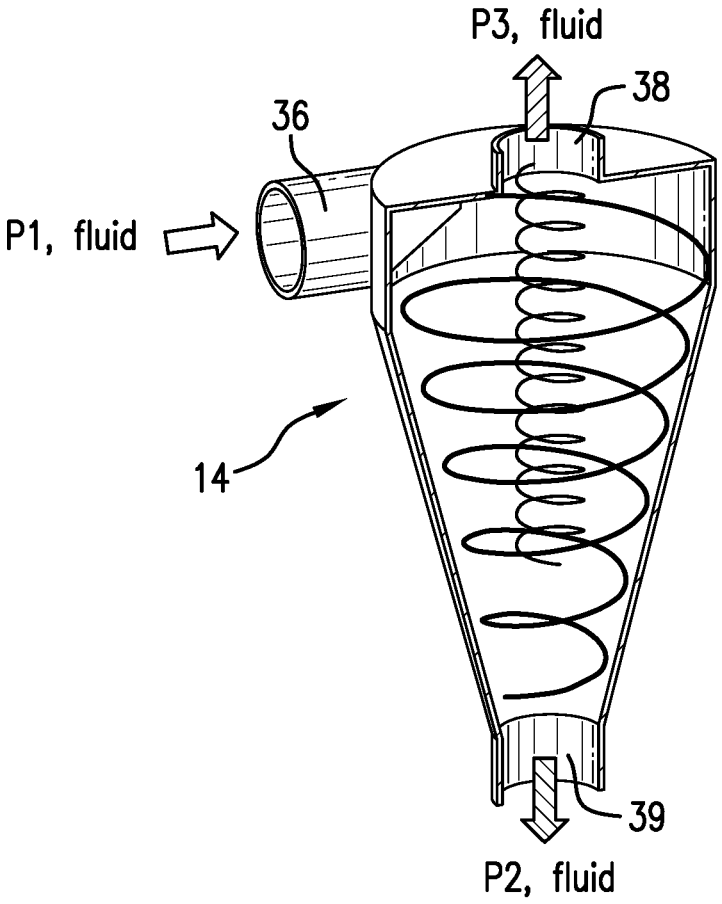
FIG. 3 is a sectional view of a hydrocyclone, illustrating pressure at different parts of the hydrocyclone.
Figure 4:
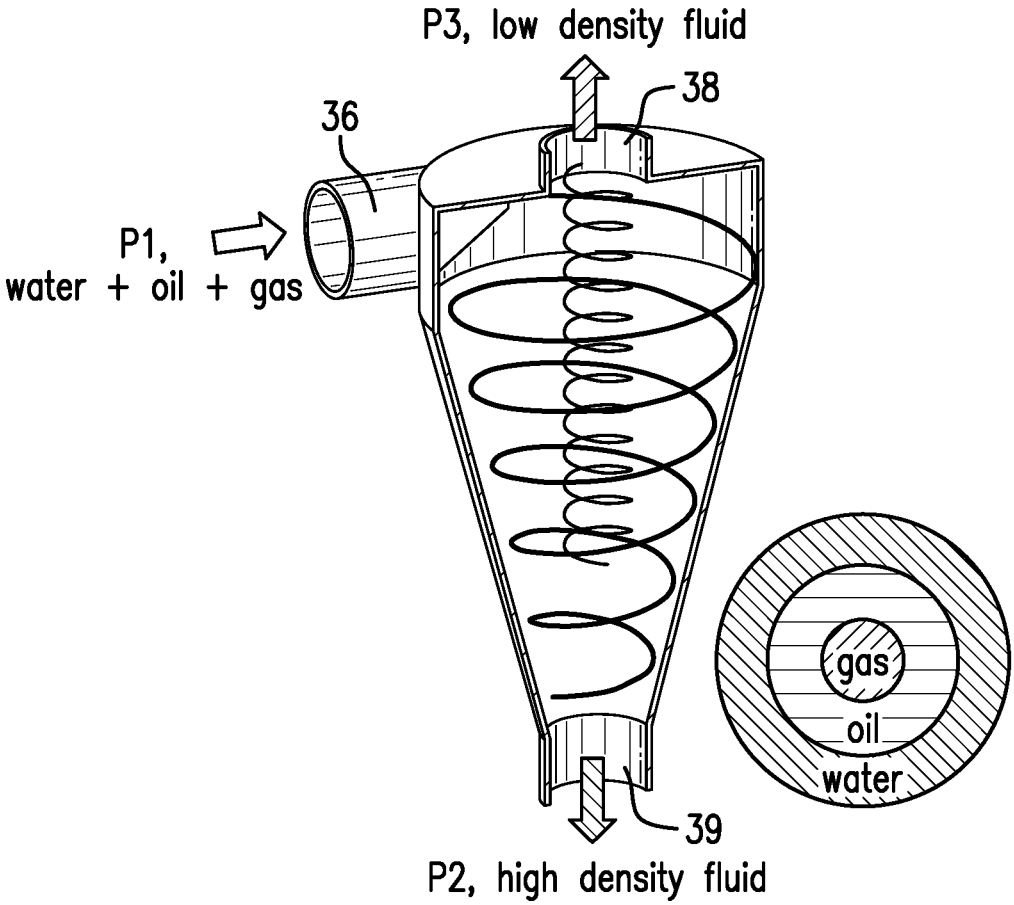
FIG. 4 is a sectional view of a hydrocyclone, illustrating pressure at different parts of the hydrocyclone and adding type of fluid associated with the different pressures.

The trigger 14, as illustrated, is a hydrocyclone. Hydrocyclones are known to separate components of mixed fluids such as oil and water based upon the densities of the fluids. Illustrations regarding the operation of a hydrocyclone are provided in FIGS. 3 and 4 (note that FIG. 4 also shows that a pilot fluid may have more than two phases therein, e.g. oil/water/gas). When a fluid mixture enters a hydrocyclone, it begins to spin. The fluid is separated into its component parts based upon density of those components and then each component exits the hydrocyclone separately. Near the exits, there is a pressure associated with each of the components. The pressure is lower than the inlet pressure, with a delta that is greater for water (or other denser fluid) than it is for oil (or lighter fluid). The difference in pressure at the pressure taps 40 and 42 at the illustrated locations in FIG. 1 when using oil and water, for example, where the viscosity of the water and the oil is the same and the density of the oil is 85% that of the water is between 5-100 pounds per square inch (PSI). It is this differential that may be used to manipulate the switch 12.

The trigger 14 has a pilot flow inlet 36 and a pilot flow outlet 38. Pilot flow may come to the pilot flow inlet 36 directly from the formation 20 as does the primary flow to primary flow inlet 16 of the switch 12 or the pilot flow to inlet 36 may come from a pilot flow outlet 38 from another trigger 14. In fact, multiple triggers may be stacked in this way to further amplify the pressure differential generated. For example, in an embodiment where there is a 5 PSI indication for pressure drop from the hydrocyclone, the differential may be magnified to 10 PSI with an additional hydrocyclone or 15 PSI with three hydrocyclones stacked in series, for example. Further additional hydrocyclones may be added in series to increase differential. Alternatively, if a pilot flow outlet 39 is made smaller in dimension than the inlet 36, the pressure drop can also be increased. It is further to be appreciated that the cone angle can be employed to create different magnitudes of pressure differential. By cone angle, it is meant an angle measured from a longitudinal axis of the cone to an inside surface of the cone. The cone angle for embodiments contemplated herein should be less than 90 degrees. The following tables illustrate pressure drop differentials for water and oil for several possible angles of the cone. These are examples only. Any other angle less than 90 degrees is also contemplated.

| Inlet Velocity: 40 ft/s | | | | | | |
|---|---|---|---|---|---|---|
| | Cone Angle | | | | | |
| | 12° | | 18° | | 30° | |
| | Fluid | | | | | |
| | Water | Oil | Water | Oil | Water | Oil |
| $P_{inlet}$ (psi) | 198.39 | 169.07 | 243.01 | 206.67 | 343.31 | 290.91 |
| $P_2$ (psi) | 46.16 | 40.46 | 47.42 | 41.53 | 48.17 | 42.17 |
| $P_3$ (psi) | 37.13 | 32.67 | 36.99 | 32.54 | 37.04 | 32.58 |
| Inlet Flow ($ft^3/s$) | 0.007454 | 0.007454 | 0.007454 | 0.007454 | 0.007454 | 0.007454 |
| Outflow 1 ($P_2$) ($ft^3/s$) | 0.003946 | 0.003942 | 0.003967 | 0.003962 | 0.003984 | 0.003979 |
| Outflow 2 ($P_3$) ($ft^3/s$) | 0.003508 | 0.003512 | 0.003488 | 0.003492 | 0.003470 | 0.003475 |
| $\Delta P_{water} - \Delta P_{oil}$ (psi) | 23.6 | | 30.5 | | 46.4 | |

$\Delta P_{water} = P_{inlet} - P_2 = 152.2$ psi
$\Delta P_{oil} = P_{inlet} - P_2 = 128.6$ psi

| Inlet Velocity: 40 ft/s | | | | |
|---|---|---|---|---|
| Cone Angle | 45° | | 60° | |
| Fluid | Water | Oil | Water | Oil |
| $P_{inlet}$ (psi) | 461.58 | 390.15 | 578.76 | 468.62 |
| $P_2$ (psi) | 47.21 | 41.34 | 45.33 | 39.72 |
| $P_3$ (psi) | 37.80 | 33.21 | 40.40 | 35.45 |
| Inlet Flow ($ft^3/s$) | 0.007454 | 0.007454 | 0.007454 | 0.007454 |
| Outflow 1 ($P^2$) ($ft^3/s$) | 0.003952 | 0.003948 | 0.003840 | 0.003838 |
| Outflow 2 ($P^3$) ($ft^3/s$) | 0.003502 | 0.003506 | 0.003615 | 0:003616 |
| $\Delta P_{water} - \Delta P_{oil}$ (psi) | 65.6 | | 84.5 | |

Regardless of where the pilot flow comes from, it is note that the amount of flow through the pilot pathway is volumetrically smaller than that flowable through the primary flow path through switch 12, when open, and accordingly has a negligible effect on the admission of an undesirable fluid to the inside diameter of the borehole equipment. The pilot flow is usable to drive the volume of fluid permitted to flow through the switch 12, depending upon the percentage of desirable fluid vs undesirable fluid in the pilot flow. For Example, if a greater percentage of oil to water is in the pilot flow then the switch 12 will open to a greater extent thereby allowing a larger volume of fluid to flow through the switch 12 into a production stream in the borehole than would be the case if the pilot flow included a percentage of water that was greater than the percentage of oil in that flow, for example. Variability of the volume of flow through switch 12 is infinite within the bounds of fully open and fully closed. In that case, the switch would choke or close. It is noted that this controlled exclusion of unwanted fluid will occur automatically and resumption of flow through the switch 12 will also occur automatically simple based upon the character of fluid flowing through the trigger 14. No input from surface is needed and no power is needed.

Still addressing the trigger 14, as a byproduct of the separation of fluid components, there is created a pressure drop that is greater for water (denser fluid) than it is for oil (less dense fluid) which effectively creates a differential between the components (oil and water as an example) after separation. This is the case with all component separation concepts, such as a tortuous path, a nozzle jet, an axial entry centrifugal separation through a swirl element or spiral path, and some of these could be substituted for the hydrocyclone illustrated, but with the hydrocyclone, the pressure differential created is as many as about 12 times the differential while the total cross-section area of the exits is larger. The much larger differential in pressure provides a correspondingly larger motive force for the switch 12 when the pressure from the separated fluids is applied to the switch 12. The larger exit area also corresponds to slower flow speed providing less erosion and more stable control. Pressure taps 40 and 42 are positioned along the trigger 14 (as shown in FIG. 1, for one exemplary placement) at points where the pressures of the separated fluids may be encountered. These taps are then ported to the switch 12 through conduits 44 and 46. Depending upon the percentage of target fluid to non-targeted fluid provided to the pilot flow inlet 36, the pressure in conduit 44 or conduit 46 will be higher than the other of 44 and 46. This allows for selection of the desired fluid through the switch 12 by causing positioning of the switch in accordance with the pressures in conduit 44 and 46 to either flow freely, choke, or stop flow.

A benefit of the hydrocyclone embodiment is that it is impervious to gravitational orientation. The hydrocyclone will separate fluids in the pilot flow and produce the pressure differential needed to actuate the switch 12 regardless of the orientation in space of the hydrocyclone 14.

Figure 2A:
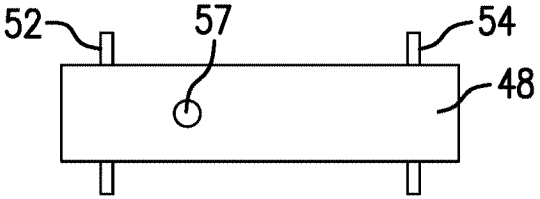
FIG. 2A is a view of the piston with a bore therethrough.

Referring to FIG. 2, the switch 12 is illustrated in cross section. It is evident that in this embodiment the switch 12 is a piston valve. A piston 48 is a shuttle within a housing 50 of switch 12 and is sealed therein by seals 52 and 54. The piston 48 in this embodiment includes a necked down portion 56 that if aligned with the primary flow inlet 16 will allow flow to proceed to the primary flow outlet 18. If the necked down portion 56 is not aligned with the primary flow inlet 16, then that flow will be interrupted. If the necked down portion 56 is only partially aligned with the primary flow inlet 16, the flow will be choked. These positions are obtained by the pressure in conduit 44 and 46 acting on opposing sides 58 and 60, respectively, of the piston 48. Where the pressure in conduit 44 is higher than that in conduit 46, the piston 48 will responsively move to the left of the Figure. If the pressures are reversed the movement of the piston 48 will be to the right of the Figure (a closing position as illustrated but it will be appreciated that the directions may be reversed). In alternate embodiments, a passage 57 could be provided through the piston 48 in substitution of the necked down portion 56, the passage being alignable or misalignable in the same way as described for the necked down portion 56 (see FIG. 2A). In some embodiments a biaser 62 is included between the housing 50 and the piston side 58 to bias the piston 48 in a direction.

In some embodiments, the chamber 24 and chamber 26 may be isolated from one another by a wall 64.

Figure 5:
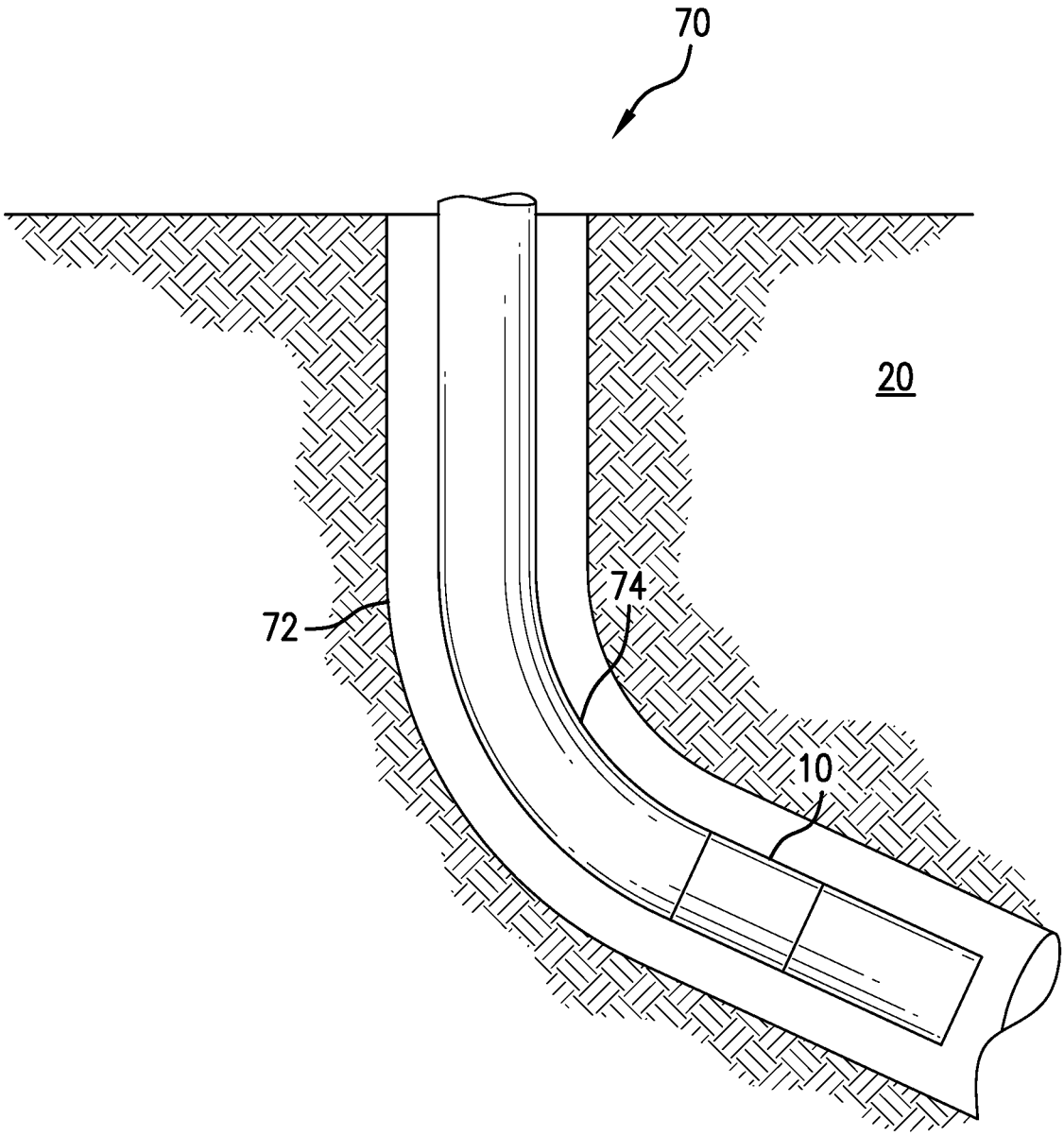
FIG. 5 is a view of a borehole system including the inflow control device as disclosed herein.

Referring to FIG. 5, a borehole system 70 is illustrated. The system 70 comprises a borehole 72 in a subsurface formation 20. A string 74 is disposed within the borehole 72. An ICD 10 as disclosed herein is disposed within or as a part of the string 74.

Set forth below are some embodiments of the foregoing disclosure:

Embodiment 1: An inflow control device (ICD), including a hydrocyclonic device having a plurality of pressure taps therein and a valve responsive to differential pressure of the plurality of pressure taps.

Embodiment 2: The ICD as in any prior embodiment, wherein the hydrocyclonic device includes a fluid inlet and a fluid outlet.

Embodiment 3: The ICD as in any prior embodiment, wherein the valve includes a primary flow inlet and a primary flow outlet.

Embodiment 4: The ICD as in any prior embodiment, wherein the valve includes a shuttle.

Embodiment 5: The ICD as in any prior embodiment, wherein the shuttle is a piston.

Embodiment 6: The ICD as in any prior embodiment, wherein the shuttle includes a flow feature that is alignable and misalignable with the primary flow inlet of the valve.

Embodiment 7: The ICD as in any prior embodiment wherein the flow feature is a neck-down of the shuttle.

Embodiment 8: The ICD as in any prior embodiment wherein the flow feature is a bore through the shuttle.

Embodiment 9: The ICD as in any prior embodiment, wherein a first of the plurality of pressure taps is located to measure pressure of a first fluid separated in the hydrocyclone.

Embodiment 10: The ICD as in any prior embodiment, wherein a second of the plurality of pressure taps is located to measure pressure of a second fluid separated in the hydrocyclone.

Embodiment 11: An inflow control device (ICD) including a switch having a primary flow inlet and a primary flow outlet, and a trigger that generates a differential pressure in the trigger due to separation of fluids having different densities.

Embodiment 12: A method for allowing flow of a desired fluid while retarding a flow of undesired fluid in a flow control device, including flowing a pilot fluid through a fluid separator, separating components of the pilot fluid, applying differential pressure of two of the separated components to a valve that is actuated by differential pressure, flowing or retarding flow of a primary flow through the valve in response to the differential pressure.

Embodiment 13: The method as in any prior embodiment, wherein separating components of the pilot fluid includes spinning the pilot fluid.

Embodiment 14: The method as in any prior embodiment, wherein the spinning separates denser fluid components from less dense fluid components.

Embodiment 15: The method as in any prior embodiment, wherein the components are oil and water.

Embodiment 16: A wellbore system, including a borehole in a subsurface formation, a string in the borehole, the ICD as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device (ICD), comprising:

a switch comprising a valve having a primary flow inlet and a primary flow outlet; and a trigger comprising a hydrocyclonic device that generates a differential pressure in the trigger due to cyclonic effect of fluids having different densities, the device having a plurality of pressure taps therein; and wherein the valve responsive to differential pressure of the plurality of pressure taps.

2. The ICD as claimed in claim 1, wherein the hydrocyclonic device includes a fluid inlet and a fluid outlet.

3. The ICD as claimed in claim 1, wherein the valve includes a shuttle.

4. The ICD as claimed in claim 3, wherein the shuttle is a piston.

5. The ICD as claimed in claim 3, wherein the shuttle includes a flow feature that is alignable and misalignable with the primary flow inlet of the valve.

6. The ICD as claimed in claim 5 wherein the flow feature is a neck-down of the shuttle.

7. The ICD as claimed in claim 5 wherein the flow feature is a bore through the shuttle.

8. The ICD as claimed in claim 1, wherein a first of the plurality of pressure taps is located to measure pressure of a first fluid separated in the hydrocyclone.

9. The ICD as claimed in claim 8, wherein a second of the plurality of pressure taps is located to measure pressure of a second fluid separated in the hydrocyclone.

10. A method for allowing flow of a desired fluid while retarding a flow of undesired fluid in a flow control device, comprising:

flowing a pilot fluid through an ICD comprising a switch having a primary flow inlet and a primary flow outlet; and a trigger that generates a differential pressure in the trigger due to cyclonic effect of fluids having different densities, separating components of the pilot fluid;

applying differential pressure of two of the separated components to the switch that is actuated by differential pressure;

flowing or retarding flow of a primary flow through the switch in response to the differential pressure.

11. The method as claimed in claim 10, wherein separating components of the pilot fluid includes spinning the pilot fluid.

12. The method as claimed in claim 11, wherein the spinning separates denser fluid components from less dense fluid components.

13. The method as claimed in claim 10, wherein the components are oil and water.

14. A wellbore system, comprising:

a borehole in a subsurface formation;

a string in the borehole;

the ICD as claimed in claim 1 disposed within or as a part of the string.

* * * * *